US011854481B1

(12) United States Patent
Yin et al.

(10) Patent No.: US 11,854,481 B1
(45) Date of Patent: Dec. 26, 2023

(54) DISPLAY PANEL AND DISPLAY DEVICE

(71) Applicant: HKC CORPORATION LIMITED, Shenzhen (CN)

(72) Inventors: Dujuan Yin, Shenzhen (CN); Haoxuan Zheng, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/068,441

(22) Filed: Dec. 19, 2022

(30) Foreign Application Priority Data

May 26, 2022 (CN) ..... 202210581840.6

(51) Int. Cl.
*G09G 3/3233* (2016.01)

(52) U.S. Cl.
CPC ... *G09G 3/3233* (2013.01); *G09G 2300/0413* (2013.01); *G09G 2300/0842* (2013.01); *G09G 2320/029* (2013.01); *G09G 2320/0233* (2013.01); *G09G 2320/045* (2013.01)

(58) Field of Classification Search
CPC ... G09G 3/32–3291; G09G 2300/0413; G09G 2300/0809–0871; G09G 2320/043; G09G 2320/045
See application file for complete search history.

(56) References Cited

U.S. PATENT DOCUMENTS 7,986,098 B2 * 7/2011 Tada ..... G09G 3/3233 315/307
8,379,004 B2 * 2/2013 Han ..... G09G 3/3233 345/205
10,297,194 B2 * 5/2019 Kim ..... G09G 3/3233
10,424,250 B2 * 9/2019 Wang ..... H10K 50/81
10,902,793 B2 * 1/2021 Oh ..... G09G 3/3266
11,217,161 B2 * 1/2022 Yin ..... G09G 3/3266
11,737,409 B1 * 8/2023 Nordick ..... A01H 5/10 800/320.1

(Continued)

FOREIGN PATENT DOCUMENTS

CN 1369916 A 9/2002
CN 101359449 A 2/2009

(Continued)

OTHER PUBLICATIONS

CNIPA, Office Action for CN Application No. 202210581840.6, dated Feb. 12, 2023.

*Primary Examiner* — Patrick F Marinelli
(74) *Attorney, Agent, or Firm* — Hodgson Russ LLP

(57) ABSTRACT

A display panel includes a display area and a non-display area surrounding the display area. The display area includes a plurality of display lines and a plurality of display sub-pixels arranged in arrays. The non-display area further includes a dummy sub-pixel, a driver chip, a feedback line and a compensation line. The driver chip is used for acquiring a current signal of a light-emitting element in the dummy sub-pixel through the feedback line, and generating a compensation signal when the current signal fed back by the feedback line is not equal to the preset threshold value, and also for generating a display compensation signal when the current signal fed back by the feedback line is equal to the preset threshold value, and the display compensation signal is transmitted to the pixel driving circuit of the display sub-pixel through the display line.

18 Claims, 6 Drawing Sheets

(56) References Cited

U.S. PATENT DOCUMENTS

| | | | | |
|---|---|---|---|---|
| 2006/0149493 | A1* | 7/2006 | Sambandan | G09G 3/3233 702/118 |
| 2008/0290806 | A1* | 11/2008 | Tada | G09G 3/3233 315/307 |
| 2010/0201656 | A1* | 8/2010 | Han | G09G 3/3233 345/205 |
| 2016/0012799 | A1* | 1/2016 | Kim | G09G 3/3233 345/82 |
| 2016/0140898 | A1* | 5/2016 | Hyun | G09G 3/3233 345/694 |
| 2018/0061314 | A1* | 3/2018 | Kim | G09G 3/3233 |
| 2018/0122302 | A1* | 5/2018 | Koong | G09G 3/035 |
| 2019/0073954 | A1* | 3/2019 | Kuang | G09G 3/3266 |
| 2019/0228709 | A1* | 7/2019 | Wang | H10K 50/82 |
| 2020/0082768 | A1* | 3/2020 | Oh | G09G 3/3291 |
| 2020/0175925 | A1* | 6/2020 | Lee | G09G 3/3258 |
| 2021/0335234 | A1* | 10/2021 | Yin | G09G 3/3291 |
| 2022/0139332 | A1* | 5/2022 | Park | G09G 3/3283 345/214 |
| 2023/0215382 | A1* | 7/2023 | Hong | G09G 3/3291 345/214 |

FOREIGN PATENT DOCUMENTS

| | | | |
|---|---|---|---|
| CN | 102024419 | A | 4/2011 |
| CN | 107230454 | A | 10/2017 |
| JP | 2019066786 | A | 4/2019 |

* cited by examiner

DISPLAY PANEL AND DISPLAY DEVICE

CROSS-REFERENCE TO RELATED APPLICATION

This application claims priority to Chinese Patent Application No. 202210581840.6, filed May 26, 2022, the entire disclosure of which is incorporated herein by reference.

FIELD OF TECHNOLOGY

The present disclosure relates to the display technical field and, more particularly, to a display panel and a display device.

BACKGROUND

An Organic Light-Emitting Diode (OLED) display panel has a wide application prospect because of its advantages of self-luminescence, high contrast, thin thickness, fast reaction speed and flexibility of the panel.

The OLED elements of the OLED display panel are current-driven elements, and a corresponding pixel driving circuit is needed to provide driving current for the OLED elements to enable the OLED elements to emit light. A pixel driving circuit of an OLED display panel generally includes a storage capacitor, a drive transistor, and other transistors electrically connected to the drive transistor. The active matrix OLED display is usually equipped with a scan driver circuit, which can output a corresponding scan signal to control the transistor in the pixel driving circuit to be on or off. However, due to the influence of environment or the characteristics of the transistor, the threshold value of transistor may drift, so the scan signal output by the scan driving circuit cannot control the transistor in the pixel driving circuit to turn off, thereby affecting the display effect of the display panel.

SUMMARY

There are provided a display panel and a display device according to embodiments of the present disclosure. The technical solution is as below:

According to a first aspect of the present application, there is provided a display panel including: a display area including a plurality of display lines and a plurality of display sub-pixels arranged in arrays; and a non-display area surrounding the display area, wherein the non-display area further includes a dummy sub-pixel, a driver chip, a feedback line and a compensation line;

wherein the dummy sub-pixel and the display sub-pixel are provided with a light-emitting element and a pixel driving circuit with the same internal configuration; wherein the light-emitting element is provided with a first pole and a second pole;

wherein in the dummy sub-pixel and the display sub-pixel, the first pole of the light-emitting element is connected to the pixel driving circuit;

wherein in the display sub-pixel, the second pole of the light-emitting element is connected to a common ground terminal, and the pixel driving circuit is connected to the driver chip through the display line;

wherein in the dummy sub-pixel, the second pole of the light-emitting element is connected to the driver chip through the feedback line, and the pixel driving circuit is connected to the driver chip through the compensation line;

wherein the driver chip is configured to acquire a current signal of a light-emitting element in the dummy sub-pixel through the feedback line, and to generate a compensation signal when the current signal fed back by the feedback line is not equal to the preset threshold value, wherein the compensation signal is inputted to a pixel driving circuit of the dummy sub-pixel through the compensation line to compensate the light-emitting element of the dummy sub-pixel, and wherein the driver chip is further configured to generate a display compensation signal based on the compensation signal when the compensation signal makes the current signal fed back by the feedback line equal to the preset threshold value, and the display compensation signal is transmitted to the pixel driving circuit of the display sub-pixel through the display line.

According to a second aspect of the present application, there is provided a display device, which includes the display panel above.

It should be understood that the above general description and the following detailed description are exemplary and explanatory only and are not intended to limit the present disclosure.

BRIEF DESCRIPTION OF THE DRAWINGS

The accompanying drawings which are incorporated in and constitute a part of the description illustrate embodiments consistent with the disclosure and together with the description serve to explain the principles of the disclosure. It will be apparent that the drawings described below are only some embodiments of the present disclosure, and other drawings may be obtained from them without creative effort for those of ordinary skill in the art.

DETAILED DESCRIPTION OF THE EMBODIMENTS

Figure 1:
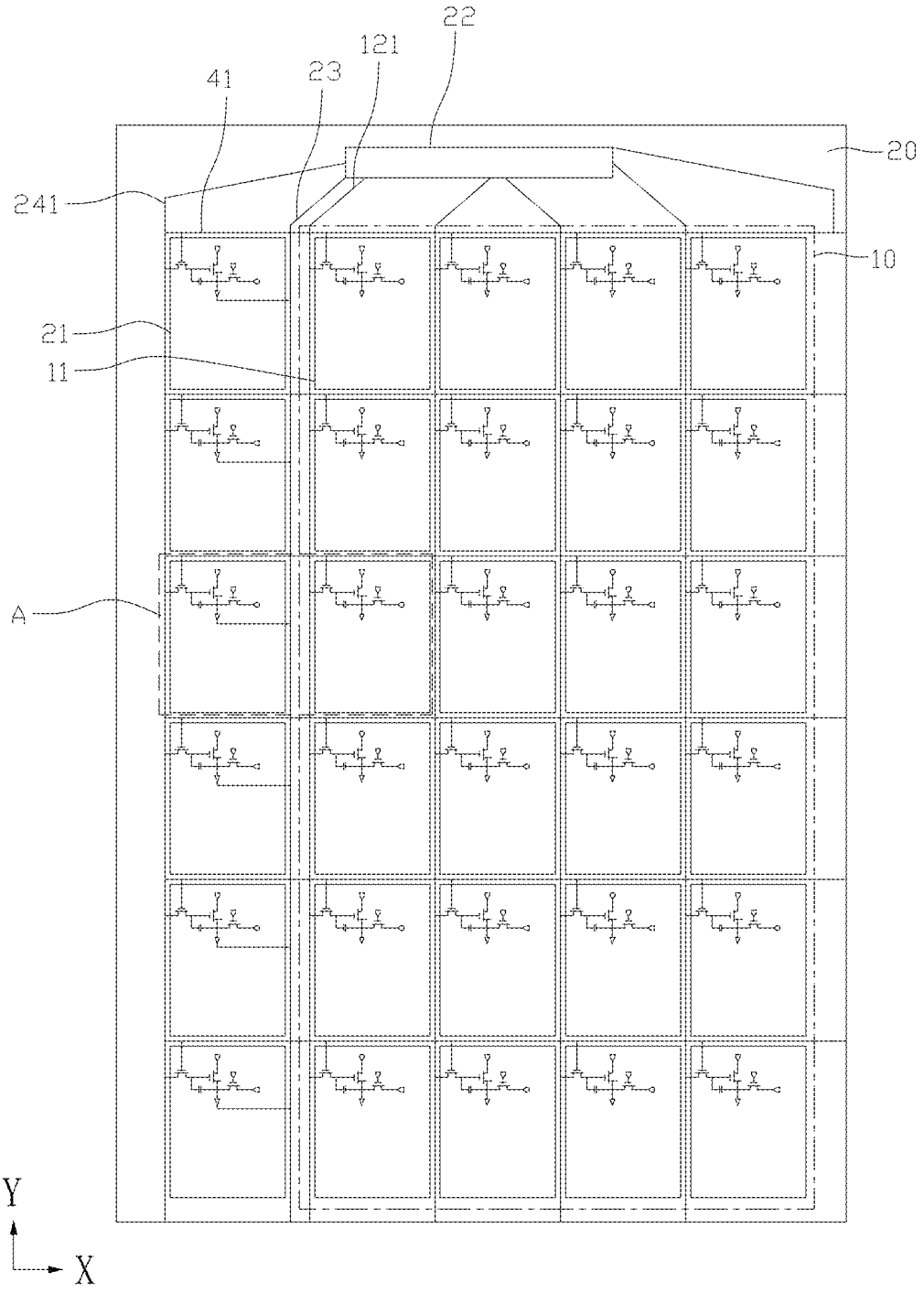
FIG. 1 shows a structural diagram of a display panel according to embodiment 1 of the present disclosure.

Exemplary embodiments will now be described more comprehensively with reference to the accompanying drawings. However, the exemplary embodiments can be implemented in a variety of forms and should not be construed as being limited to the examples set forth herein. Rather, these embodiments are provided so that the present disclosure will be more comprehensive and complete, and the concept of exemplary embodiments will be fully communicated to those skilled in the art.

In the present disclosure, the terms "first", "second" are used for descriptive purposes only and are not to be construed as indicating or implying relative importance or as implying the number of technical features indicated. Thus, the features defined as "first" or "second" may be explicitly or implicitly defined as including one or more of the features. In the description of the present disclosure, "a plurality of" means two or more, unless explicitly and specifically defined otherwise.

Further, the described features, structures or characteristics may be incorporated in any suitable manner in one or more embodiments. In the following description, many specific details are provided to give a full understanding of the embodiments of the present disclosure. However, those skilled in the art will appreciate that one or more of the technical solutions of the present disclosure may be practiced without particular details, or other methods, group elements, devices, steps, etc. may be employed. In other instances, well-known methods, devices, implementations or operations are not shown or described in detail to avoid obscuring aspects of the present disclosure.

Embodiment 1

Referring to FIGS. 1 to 4, the embodiments of the present disclosure provide a display panel including a display area 10 and a non-display area 20 surrounding the display area 10.

The display area 10 includes a plurality of display sub-pixels 11, the display sub-pixels 11 are arrayed in a row direction X and a column direction Y, and a plurality of columns of display sub-pixels 11 are provided and arranged in the row direction X.

The non-display area 20 includes a dummy sub-pixel 21, which can be understood as a complete device formed by a light-emitting element and a pixel driving circuit. The light-emitting element in the dummy sub-pixel 21 can be specifically a dummy light-emitting element 211, and the pixel driving circuit can be specifically a dummy pixel driving circuit 212. Similarly, the display sub-pixel 11 can also be understood as a complete device formed by a light-emitting element and a pixel driving circuit, where the light-emitting element in the display sub-pixel 11 can be specifically a display light-emitting element 111, and the pixel driving circuit can be specifically a display pixel driving circuit 112.

Further, the dummy sub-pixel 21 is disposed on one side of the display area 10, and is disposed close to an edge of the display sub-pixel 11, so that the environment in which the elements in the dummy sub-pixel 21 are located is almost identical to the environment in which the elements in the display sub-pixel 11 are located. Therefore, by detecting the current change of the dummy sub-pixel 21 of the complete device, the current change of the display pixel driving circuit 112 and the display light-emitting element 111 in the display sub-pixel 11 can be more accurately detected so as to provide more accurate and timely feedback.

It should be understood that when threshold drift occurs in the dummy pixel driving circuit 212 of the dummy sub-pixel 21 and in the display pixel driving circuit 112 of the display sub-pixel 11 due to the influence of the environment, the currents of the dummy pixel driving circuit 212 of the dummy sub-pixel 21 and the display pixel driving circuit 112 of the display sub-pixel 11 have almost the same trend of change, and accordingly, the currents of the dummy light-emitting element 211 of the dummy sub-pixel 21 and the display light-emitting element 111 of the display sub-pixel 11 also change. Therefore, when the dummy light-emitting element 211 and the dummy pixel driving circuit 212 of the dummy sub-pixel 21 and the display light-emitting element 111 and the display pixel driving circuit 112 of the display sub-pixel 11 are in nearly the same environment, the actual current change of the display pixel driving circuit 112 and the display light-emitting element 111 in the display sub-pixel 11 in the display area 10 can be approximately obtained by detecting the current change of the whole device formed by the dummy light-emitting element 211 and the dummy pixel driving circuit 212 of the dummy sub-pixel 21 in the non-display area 20.

In addition, the dummy sub-pixels 21 are provided in the non-display area 20, so that real-time detection of the current change of the display pixel driving circuit 112 and the current change of the display light-emitting element 111 of the display sub-pixels 11 in the display area 10 can be achieved without affecting the normal display light emission of each display sub-pixel 11.

In this embodiment, the dummy sub-pixel 21 and the display sub-pixel 11 have the same internal configuration as the light-emitting element and the pixel driving circuit. Specifically, the dummy light-emitting element 211 and the dummy pixel driving circuit 212 of the dummy sub-pixel 21 and the display light-emitting element 111 and the display pixel driving circuit 112 of the display sub-pixel 11 are formed of the same material under the same process. The dimensions of the dummy light-emitting element 211 and the dummy pixel driving circuit 212 of the dummy sub-pixel 21 are the same as those of the display light-emitting element 111 and the display pixel driving circuit 112 of the display sub-pixel 11.

So, on the one hand, when the dummy light-emitting element 211 and the dummy pixel driving circuit 212 of the dummy sub-pixel 21 and the display light-emitting element 111 and the display pixel driving circuit 112 of the display sub-pixel 11 are formed of the same material under the same process, the process of the display panel is simplified, the production efficiency of the display panel is increased, and the production cost of the display panel is reduced. On the other hand, when the dummy light-emitting element 211 and the dummy pixel driving circuit 212 of the dummy sub-pixel 21 and the display light-emitting element 111 and the display pixel driving circuit 112 of the display sub-pixel 11 are formed of the same material under the same process and have the same size, the dummy light-emitting element 211 and the dummy pixel driving circuit 212 of the dummy sub-pixel 21 have the same characteristics as the display light-emitting element 111 and the display pixel driving circuit 112 of the display sub-pixel 11. At this time, while detecting the current change of the dummy light-emitting element 211 in the dummy sub-pixel 21, it is almost equivalent to detecting the current change of the display light-emitting element 111 in the display sub-pixel 11, so that the corresponding adjustment can be made more accurately.

Alternatively, the light-emitting elements of the dummy sub-pixel 21 and the display sub-pixel 11 are organic electroluminescent elements (OLED), for example.

In this embodiment, the non-display area 20 may include a plurality of dummy sub-pixels 21, the plurality of dummy sub-pixels 21 are arranged in at least one column. For each column of the dummy sub-pixels, the number of dummy sub-pixels 21 is equal to the number of display sub-pixels 11 and corresponds one-to-one in the row direction X.

In this embodiment, the non-display area 20 also includes a driver chip 22. The dummy light-emitting element 211 of the dummy sub-pixel 21 has a first pole and a second pole. The first pole of the dummy light-emitting element 211 of the dummy sub-pixel 21 is connected to the dummy pixel driving circuit 212 of the dummy sub-pixel 21, and the dummy pixel driving circuit 212 of the dummy sub-pixel 21 is connected to the driver chip 22. The second pole of the dummy light-emitting element 211 of the dummy sub-pixel 21 is connected to the driver chip 22.

It should be understood that since the dummy light-emitting element 211 of the dummy sub-pixel 21 and the dummy pixel driving circuit 212 can be electrically conducted together to form a complete device, the current change of the entire device can be obtained by detecting the current change of the dummy light-emitting element 211 or the dummy pixel driving circuit 212 in the dummy sub-pixel 21, thereby acquiring the current changes of the display pixel driving circuit 112 and the display light-emitting element 111 in the display sub-pixel 11.

In this embodiment, the display area 10 includes a plurality of display lines 121. The display light-emitting element 111 of the display sub-pixel 11 in the display area 10 also has a first pole and a second pole. The first pole of the display light-emitting element 111 of the display sub-pixel 11 is connected to a display pixel driving circuit 112 of the display sub-pixel 11, the second pole of the display light-emitting element 111 of the display sub-pixel 11 is connected to a common ground terminal, and the display pixel driving circuit 112 of the display sub-pixel 11 is connected to the driver chip 22 through the display line 121.

Accordingly, the non-display area 20 also includes a feedback line 23 and a compensation line. The second pole of the dummy light-emitting element 211 of the dummy sub-pixel 21 is connected to the driver chip 22 through the feedback line 23, and the dummy pixel driving circuit 212 is connected to the driver chip 22 through the compensation line.

In this embodiment, the compensation line is a data signal compensation line 241.

It should be understood that the driver chip 22 is used for acquiring the current signal of the dummy light-emitting element 211 in the dummy sub-pixel 21 through the feedback line 23, and generates a compensation signal when the current signal fed back by the feedback line 23 is not equal to the preset threshold value. The compensation signal is inputted to the dummy pixel driving circuit 212 of the dummy sub-pixel 21 through the compensation line to compensate the dummy light-emitting element 211 of the dummy sub-pixel 21. The driver chip 22 is also used for generating a display compensation signal based on the compensation signal when the compensation signal makes the current signal fed back by the feedback line 23 equal to the preset threshold value, and transmitting the display compensation signal to the pixel driving circuit 112 of the display sub-pixel 11 through the display line 121 until the current of the display pixel driving circuit 112 in the display sub-pixel 11 is restored to a normal level and remains constant, thereby balancing the display luminance of the display panel, that is, the compensation is completed.

Figure 2:
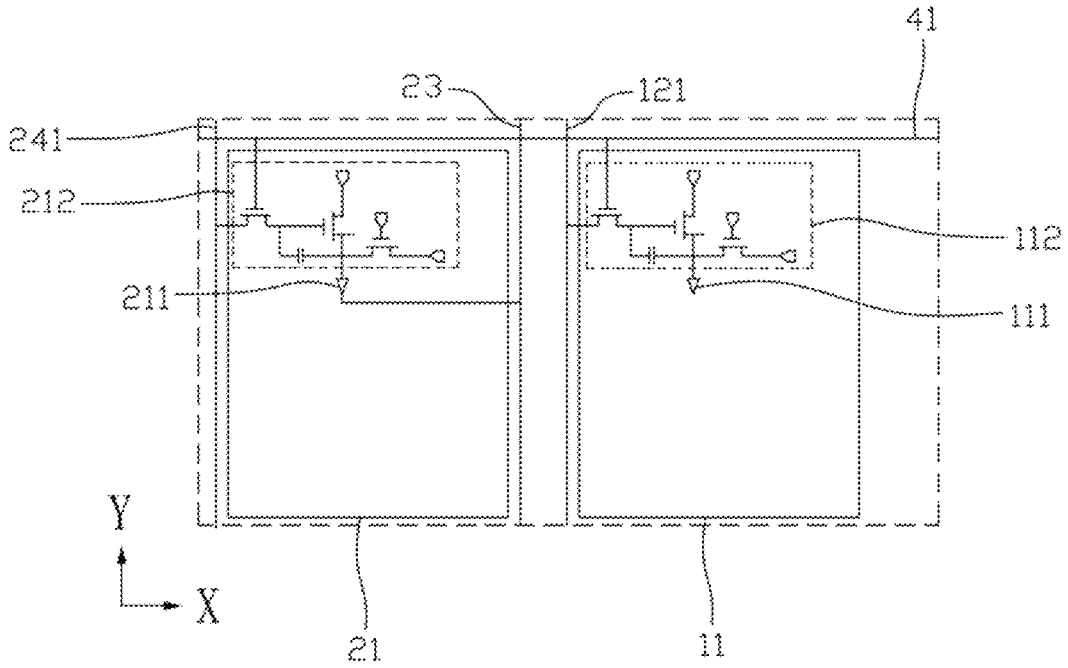
FIG. 2 shows an enlarged structural diagram at part A of the display panel shown in FIG. 1.
Figure 3:
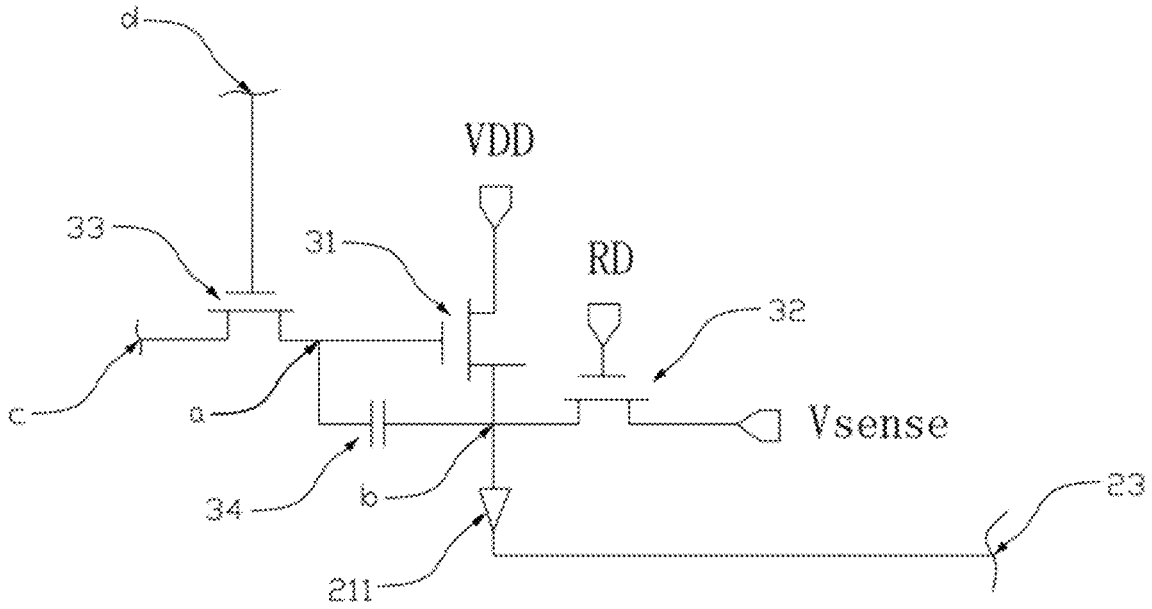
FIG. 3 shows a schematic diagram of an electrical connection between a dummy light-emitting element and a dummy pixel driving circuit in a dummy sub-pixel according to embodiment 1 of the present disclosure.
Figure 4:
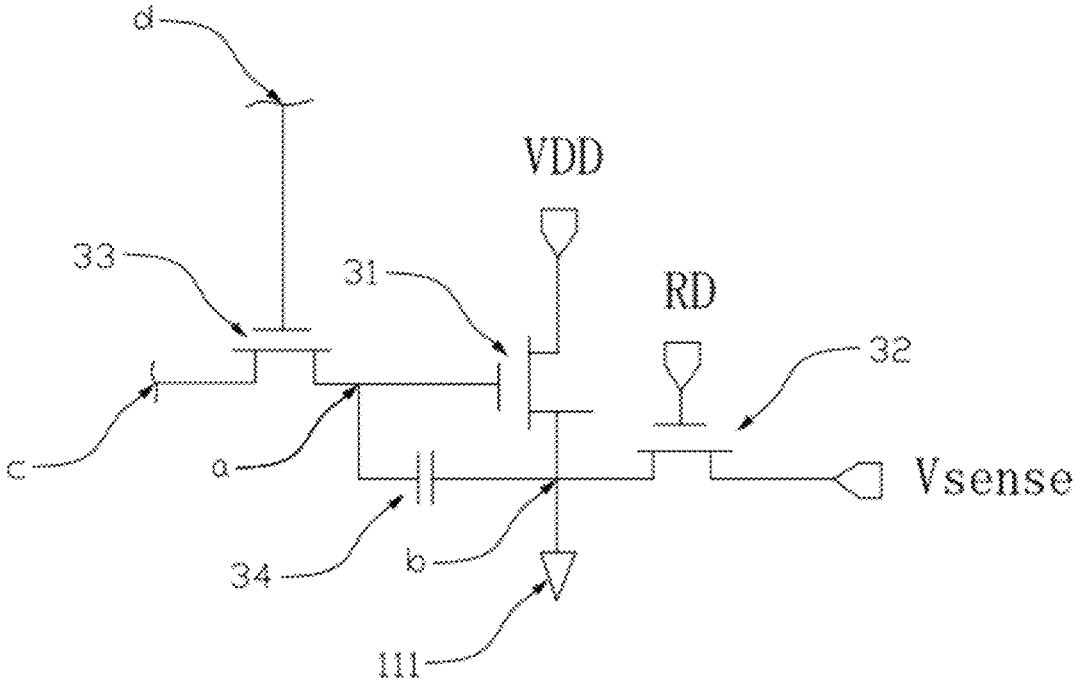
FIG. 4 is a schematic diagram of an electrical connection between a display light-emitting element and a display pixel driving circuit in a display sub-pixel according to an embodiment of the present disclosure.

In this embodiment, as shown in FIGS. 2, 3, and 4, the pixel driving circuits of the dummy sub-pixel 21 and the display sub-pixel 11 each include a drive transistor 31, a reset transistor 32, a charge transistor 33, and a storage capacitor 34.

Optionally, the drive transistor 31 is an oxide semiconductor transistor.

The first pole of the storage capacitor 34 is connected to a first node a, the second pole of the storage capacitor 34 is connected to a second node b, and the second node b is connected to the first pole of the light-emitting element. A control terminal of the drive transistor 31 is connected to the first node a, a first terminal of the drive transistor 31 is connected to a power supply voltage terminal VDD, and a second terminal of the drive transistor 31 is connected to the second node b. A control terminal of the reset transistor 32 is connected to a read signal RD, a first terminal of the reset transistor 32 is connected to a reference signal Vsense, and a second terminal of the reset transistor 32 is connected to the second node b. A control terminal of the charge transistor 33 is a scan signal write terminal d, a first terminal of the charge transistor 33 is a data signal write terminal c, and a second terminal of the charge transistor 33 is connected to the first node a.

In addition, the drive transistor 31, the reset transistor 32, the charge transistor 33, and the storage capacitor 34 together form a pixel driving circuit with a 3T1C (3 Transistor-1 Capacitor) structure, so that when the display panel reads bit information stored in the capacitor, the charge of the capacitor will not be affected, the cell does not need to be precharged after reading. The pixel driving circuit with the configuration of 3T1C can compensate the threshold voltage of the drive transistor 31 to make the display brightness of the display panel more uniform.

In this embodiment, the display line 121 includes a data signal line. The data signal line is connected to the driver chip 22 and the data signal write terminal c of the display pixel driving circuit 112 in the display sub-pixel 11.

For example, at least one data signal line is provided and extends in the column direction Y, and the first terminals of the charge transistors 33 in the display sub-pixels 11 of the same column are all electrically connected to the same data signal line. Further, the data signal transmitted by the data signal line is written to the gate of the drive transistor 31 in the corresponding display sub-pixel 11 by turning on the charge transistor 33 of the display sub-pixel 11.

Further, the data signal compensation line 241 connects the driver chip 22 and the data signal write terminal c of the dummy pixel driving circuit 212 in the dummy sub-pixel 21.

Accordingly, the driver chip 22 generates a data compensation signal when the current signal fed back by the feedback line 23 is not equal to the preset threshold value, and the data signal compensation line 241 transmits the data compensation signal to the data signal write terminal c of the dummy sub-pixel 21.

Meanwhile, the driver chip 22 is also used for generating a display compensation signal based on the compensation signal when the current signal fed back by the feedback line 23 is equal to the preset threshold value after compensation, and the display compensation signal is transmitted to the data signal write terminal c of the display sub-pixel 11 through the display line until the current of the display pixel driving circuit 112 in the display sub-pixel 11 is restored to a normal level and remains constant, thereby balancing the display luminance of the display panel, that is, the compensation is completed.

It should be understood that the read signal RD and the reference signal Vsense are provided by the driver chip 22.

In this embodiment, at least one data signal compensation line 241 is provided and extends in the column direction Y and one data signal compensation line 241 is connected to a first terminal of the charge transistor 33 in each dummy sub-pixel 21 in a column. The data signal transmitted by the data signal compensation line 241 is then written to the gate of the drive transistor 31 in the corresponding dummy sub-pixel 21 by turning on the charge transistor 33 in the dummy sub-pixel 21.

Figure 7:
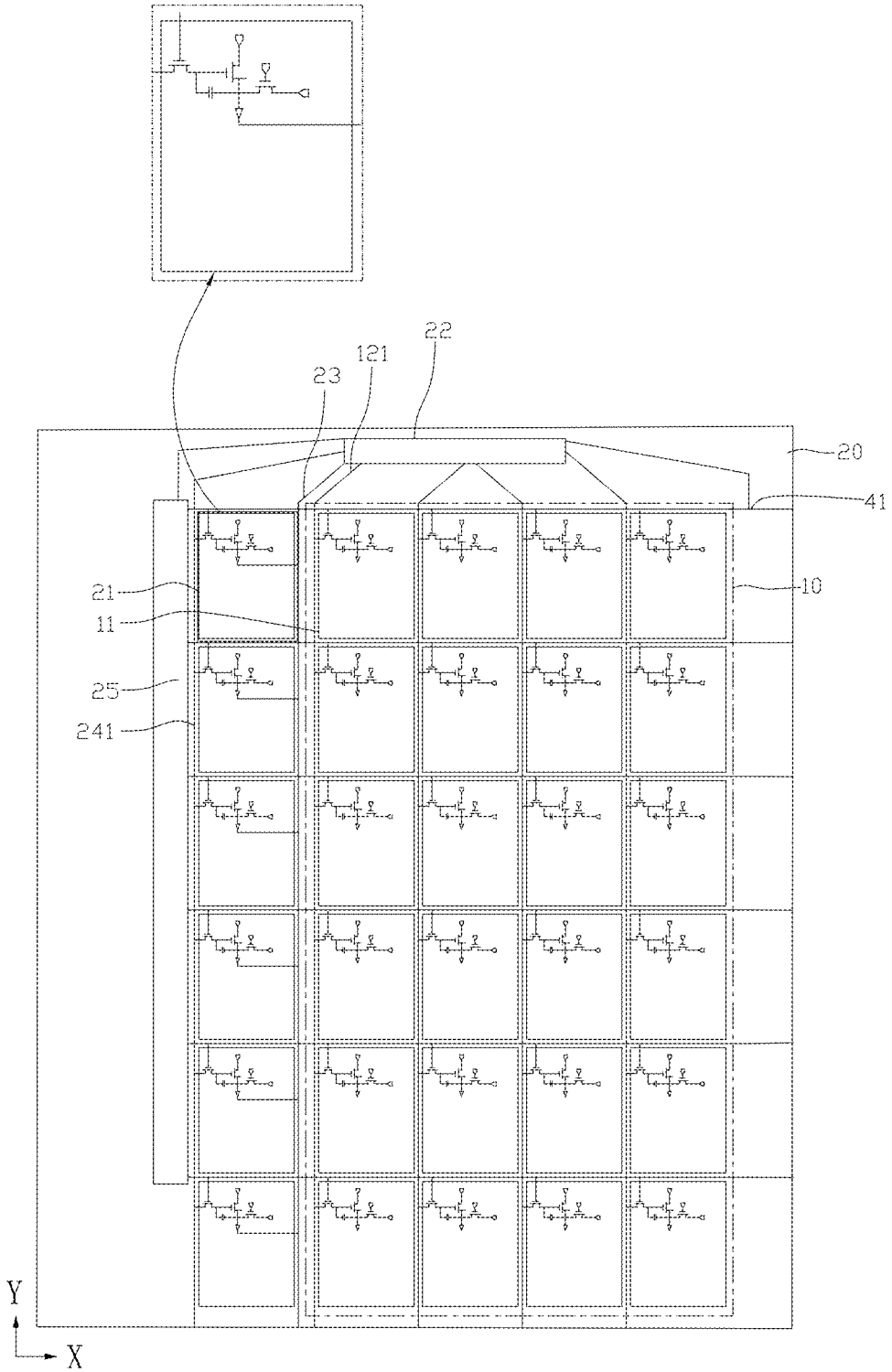
FIG. 7 is a structural schematic diagram of a display panel with a gate driving circuit according to embodiment 2 of the present disclosure.

Further, referring to FIG. 7, the non-display area 20 is provided with a gate driving circuit 25 connected to the driver chip 22. The gate driving circuit 25 is connected to the scan signal write terminals d of the pixel driving circuit of the dummy sub-pixel 21 and of the display sub-pixel 11 on the same row through a scan signal line 41, the scan signal line 41 extends in the row direction X.

For example, the control terminals of the charge transistors 33 of the dummy sub-pixels 21 and of the display sub-pixels 11 on the same row are electrically connected to the same scan signal line 41. The driver chip 22 supplies a scan signal to the charge transistors 33 of the dummy sub-pixel 21 and of the display sub-pixel 11 through the gate driving circuit 25 and the scan signal line 41, and the driver chip 22 can further control the on and off of the charge transistors 33 of the dummy sub-pixel 21 and of the display sub-pixel 11.

It should be understood that when the charge transistors 33 of the dummy sub-pixel 21 and of the display sub-pixel 11 located in the same row share one scan signal line, the scan signal supplied by the gate driving circuit 25 can be sequentially supplied to the gates of the charge transistors 33 of the dummy sub-pixels 21 and of the display sub-pixels 11 through the scan signal lines of each row, so that the conduction of the charge transistors 33 of the dummy sub-pixels 21 and of the display sub-pixels 11 can be sequentially controlled.

Further, the gate driving circuit 25 is located on the side of the dummy sub-pixel 21 away from the display sub-pixel 11. The dummy sub-pixel 21 is disposed further close to the edge of display sub-pixel 11. The environment of the dummy light-emitting element 211 of the dummy sub-pixel 21 and the display light-emitting element 111 of the display sub-pixel 11 are more closely identical. Therefore, when threshold drift occurs in the dummy light-emitting element 211 of the dummy sub-pixel 21 and in the display light-emitting element 111 of the display sub-pixel 11 due to environmental influence, the current of the whole device with the dummy light-emitting element 211 in the dummy sub-pixel 21 and the current of the whole device with the display light-emitting element 111 in the display sub-pixel 11 have the same variation trends.

Based on this, the display panel of this embodiment is provided with the dummy sub-pixel 21 in the non-display area 20 close to the edge of the display area 10, and the dummy sub-pixel 21 and the display sub-pixel 11 are provided with a light-emitting element and a pixel driving circuit having the same internal configuration. The driver chip 22 can then detect the current change of the entire integrated device composed of the dummy pixel driving circuit 212 and the dummy light-emitting element 211 in the dummy sub-pixel 21, so as to detect the current change of the entire integrated device composed of the display pixel driving circuit 112 and the display light-emitting element 111 in the display sub-pixel 11.

Therefore, the driver chip 22 generates a compensation signal when receiving the current signal fed back by the feedback line 23 that is not equal to the preset threshold value. The compensation signal can be inputted to the dummy pixel driving circuit 212 of the dummy sub-pixel 21 through the data signal compensation line 241 to compensate the dummy light-emitting element 211 of the dummy sub-pixel 21 until the driver chip 22 receives the current signal fed back by the feedback line 23 equal to the preset threshold. Meanwhile, the driver chip 22 generates a display data compensation signal based on the data compensation signal, and transmits the display data compensation signal to the data signal write terminal c of the display sub-pixel 11 through the data signal line until the current of the display pixel driving circuit 112 and of the display light-emitting element 111 in the display sub-pixel 11 is restored to a normal level and remains constant, thereby balancing the display luminance of the display panel, that is, the compensation is completed.

Embodiment 2

Figure 5:
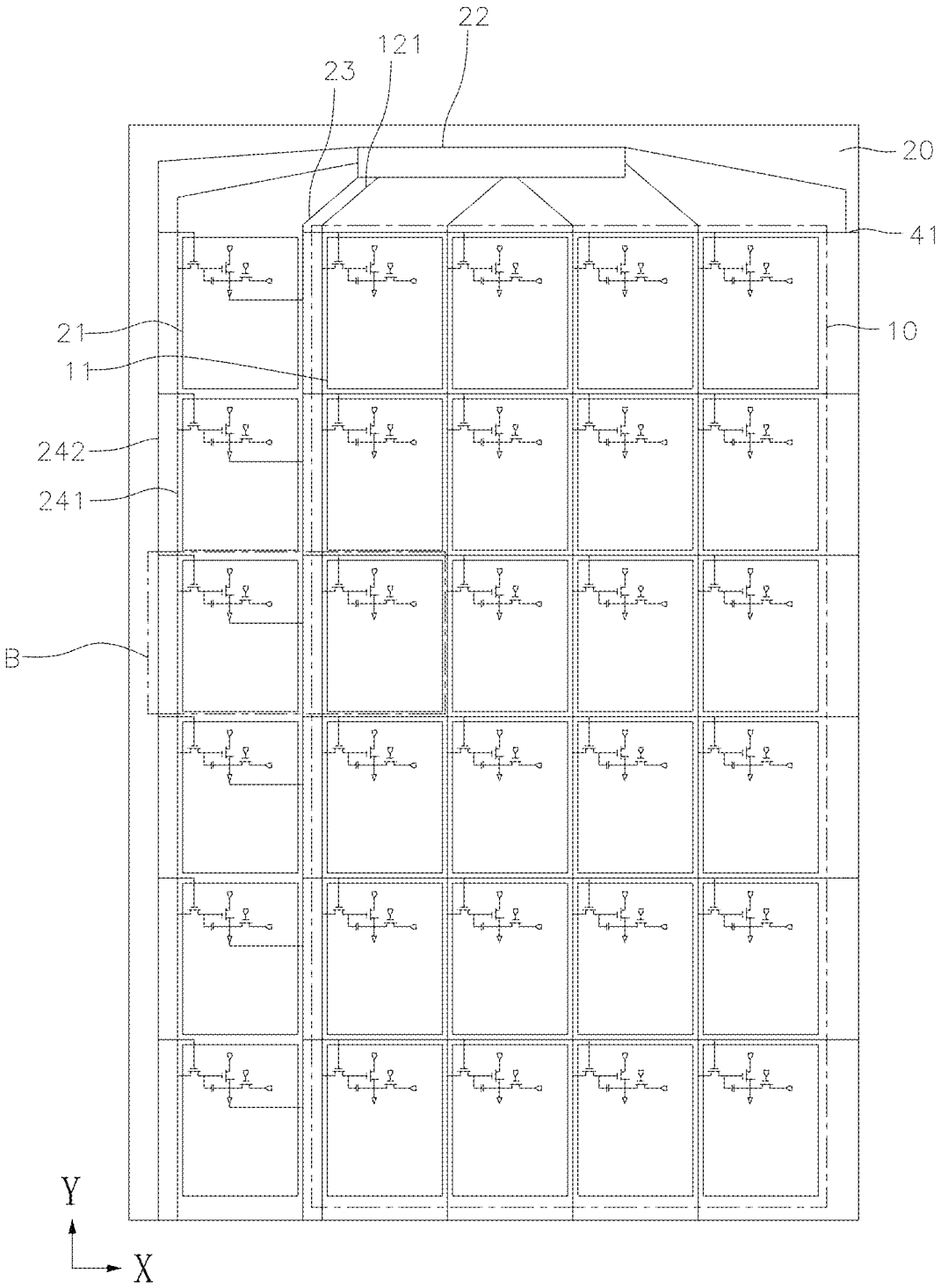
FIG. 5 is a structural schematic diagram of a display panel according to embodiment 2 of the present disclosure.
Figure 6:
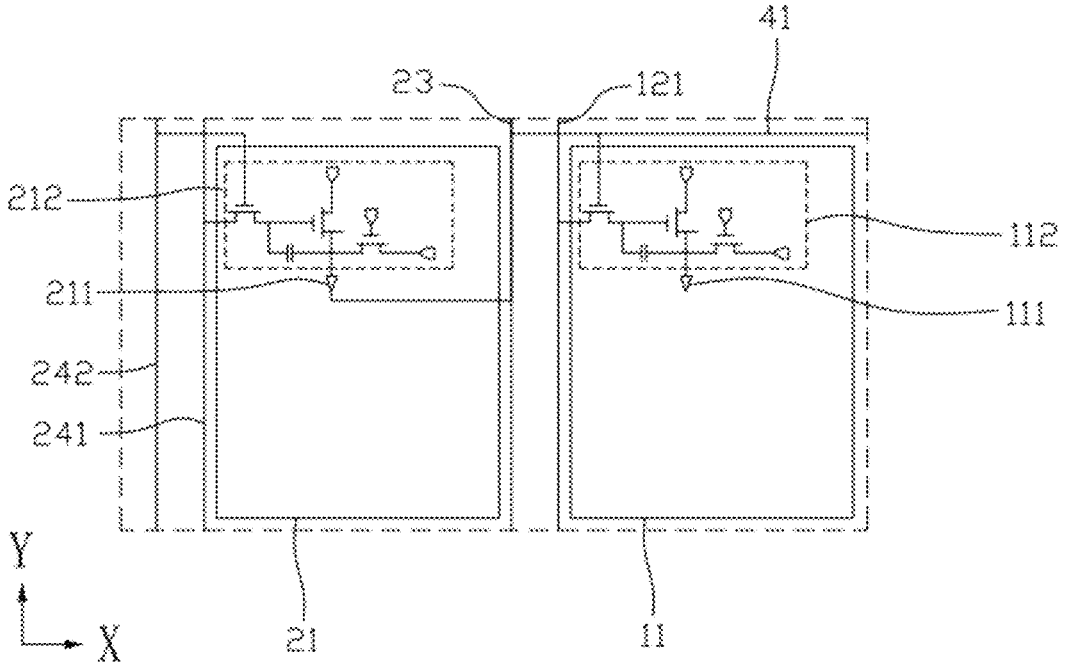
FIG. 6 is an enlarged structural diagram at part B of the display panel shown in FIG. 5.

Referring to FIG. 5 and FIG. 6, the configuration of the display panel in this embodiment is approximately the same as that of the display panel in embodiment 1, but there are also some differences, such as compensation line, that is, the compensation line in this embodiment is different from that in embodiment 1.

In this embodiment, the compensation line includes a data signal compensation line 241. The data signal compensation line 241 connects the driver chip 22 and the data signal write terminal c of the dummy pixel driving circuit 212 in the dummy sub-pixel 21.

Accordingly, the driver chip 22 generates a data compensation signal when the current signal fed back by the feedback line 23 is not equal to the preset threshold value, and the data signal compensation line 241 transmits the data compensation signal to the data signal write terminal c of the dummy sub-pixel 21. Meanwhile, the driver chip 22 is further configured to generate a display data compensation signal based on the data compensation signal when the current signal fed back by the feedback line 23 after compensation is equal to the preset threshold value, and the display data compensation signal is transmitted to the data signal write terminal c of the display sub-pixel 11 through the data signal line.

In this embodiment, the non-display area 20 is further provided with a gate driving circuit 25 connected to the driver chip 22, and the gate driving circuit 25 is connected to a scan signal write terminal d of the display pixel driving circuit 112 in the display sub-pixel 11 through the scan signal line 41. The scan signal line 41 extends in the row direction X.

For example, at least one scan signal line 41 is provided and extends in the row direction X, and control terminals of the charge transistors 33 of the display sub-pixels 11 on the same row are electrically connected to the same scan signal line 41.

The driver chip 22 supplies a scan signal to the charge transistor 33 of the display sub-pixel 11 through the gate driving circuit 25 and the scan signal line 41, and the driver chip 22 can further control the on and off of the charge transistor 33 of the display sub-pixel 11.

It should be understood that when the charge transistors 33 of the display sub-pixels 11 located in the same row share one scan signal line, the scan signal supplied by the gate driving circuit 25 can be sequentially supplied to the gates of the charge transistors 33 of the display sub-pixels 11 in each row through the scan signal line, so that the conduction of the charge transistors 33 of the display sub-pixels 11 in each row can be sequentially controlled.

Further, the compensation line also includes at least one scan signal compensation line 242 extending in the column direction Y. The scan signal compensation line 242 is spaced from the data signal compensation line 241, and one scan signal compensation line 242 is connected to the scan signal write terminal d of each dummy sub-pixel 21 in a column, and is also connected to the driver chip 22.

Accordingly, the driver chip 22 is also used for generating a scan compensation signal when the current signal fed back by the feedback line 23 is not equal to the preset threshold value, and the scan compensation signal is transmitted to the scan signal write terminal d of each dummy sub-pixel 21 through the scan signal compensation line 242.

Meanwhile, when the current signal fed back by the compensated feedback line 23 is equal to the preset threshold value, the driver chip 22 outputs a display scan compensation signal to the gate driving circuit 25 based on the scan compensation signal, and the display scan compensation signal is transmitted to the scan signal write terminal d of the display sub-pixel 11 through the scan signal line 41.

The scan signal line 41 and the scan signal compensation line 242 are arranged in different layers and insulated from each other to avoid short circuit between the scan signal line 41 and the scan signal compensation line 242.

Based on this, when receiving the current signal fed back by the feedback line 23 that is not equal to the preset threshold value, the driver chip 22 can generate a data compensation signal, and the data compensation signal is input to the dummy pixel driving circuit 212 of the dummy sub-pixel 21 through the data signal compensation line 241 to compensate the dummy light-emitting element 211 of the dummy sub-pixel 21. It is also possible to generate a scan compensation signal and then the scan compensation signal is input into the dummy pixel driving circuit 212 of the dummy sub-pixel 21 through the scan signal compensation line 242 to compensate the dummy light-emitting element 211 of the dummy sub-pixel 21. Therefore, the dummy light-emitting element 211 in the dummy sub-pixel 21 can be more accurately compensated by the driver chip 22 cooperating with the data signal compensation line 241 and the scan signal compensation line 242. Finally, the driver chip 22 generates a display data compensation signal based on the data compensation signal, and the display data compensation signal is transmitted to the data signal write terminal c of the display sub-pixel 11 through the data signal line. The driver chip 22 outputs the display scan compensation signal to the gate driving circuit based on the scan compensation signal, and then the display data compensation signal is transmitted to the scan signal write terminal d of the display sub-pixel 11 through the scan signal line 41. Further, the current of the display pixel driving circuit 112 and the display light-emitting element 111 in the display sub-pixel 11 is better restored to a normal level and remains constant, thereby further ensuring that the display luminance of the display panel is even, that is, the compensation is completed.

For other configurations of the display panel of this embodiment, please refer to embodiment 1 and will not be described here.

Embodiment 3

The embodiment also provides a display device, which includes a display panel in embodiment 1 or embodiment 2. The display device is a mobile phone, a computer, an automobile display, an advertisement display board and the like, for example.

For other configurations of the display panel of the display device in this embodiment, please refer to embodiment 1 or embodiment 2 and will not be described here.

In the description of this description, illustrations of the reference terms "some embodiments", "exemplified", etc. mean that specific features, structures, materials, or features described in connection with the embodiment or example are included in at least one embodiment or example of the present disclosure. In the description, the schematic formulation of the above terms need not be directed to the same embodiments or examples. Further, the specific features, structures, materials or features described may be combined in a suitable manner in any one or more embodiments or examples. Further, without contradicting one another, those skilled in the art may combine and incorporate different embodiments or examples described in the description and features of different embodiments or examples.

Although the embodiments of the present disclosure have been shown and described above, understandably, the above-described embodiments are exemplary and cannot be construed as limiting the present disclosure. Those of ordinary skill in the art may make changes, modifications, substitutions and modifications to the above-described embodiments within the scope of the present disclosure. Therefore, any changes or modifications made in accordance with the claims and descriptions of the present disclosure should fall within the scope of the present disclosure.

What is claimed is:

1. A display panel comprising:

a display area comprising a plurality of display lines and a plurality of display sub-pixels arranged in arrays; and a non-display area surrounding the display area, wherein the non-display area further comprises a dummy sub-pixel, a driver chip, a feedback line and a compensation line;

wherein the dummy sub-pixel and the plurality of display sub-pixels are provided with a light-emitting element and a pixel driving circuit with the same internal configuration;

wherein the light-emitting element is provided with a first pole and a second pole; wherein in the dummy sub-pixel and the plurality of display sub-pixels, the first pole of the light-emitting element is connected to the pixel driving circuit;

wherein in the plurality of display sub-pixels, the second pole of the light-emitting element is connected to a common ground terminal, and the pixel driving circuit is connected to the driver chip through the display line;

wherein in the dummy sub-pixel, the second pole of the light-emitting element is directly connected to the driver chip through the feedback line, and the pixel driving circuit is connected to the driver chip through the compensation line; and wherein the driver chip is configured to acquire a current signal of a light-emitting element in the dummy sub-pixel through the feedback line, and to generate a compensation signal when the current signal fed back by the feedback line is not equal to a preset threshold value, wherein the compensation signal is inputted to a pixel driving circuit of the dummy sub-pixel through the compensation line to compensate the light-emitting element of the dummy sub-pixel, and wherein the driver chip is further configured to generate a display compensation signal based on the compensation signal when the compensation signal makes the current signal fed back by the feedback line equal to the preset threshold value, and the display compensation signal is transmitted to the pixel driving circuit of the display sub-pixel through the display line.

2. The display panel according to claim 1, wherein the plurality of display lines comprise a data signal line for connecting the driver chip and a data signal write terminal of the pixel driving circuit in the plurality of display sub-pixels;

wherein the compensation line comprises a data signal compensation line for connecting the driver chip and the data signal write terminal of the pixel driving circuit in the dummy sub-pixel;

wherein the driver chip is configured to generate a data compensation signal when the current signal fed back by the feedback line is not equal to the preset threshold value, and the data signal compensation line transmits the data compensation signal to the data signal write terminal of the dummy sub-pixel; and wherein the driver chip is further configured to generate a display data compensation signal based on the data compensation signal when the current signal fed back by the feedback line after compensation is equal to the preset threshold value, and the data signal line transmits the display data compensation signal to the data signal write terminal of the plurality of display sub-pixels through the data signal line.

3. The display panel according to claim 2, wherein a plurality of columns of display sub-pixels are provided in a row direction;

wherein at least one column of dummy sub-pixels is provided, at least one data signal compensation line is provided and extends in a column direction, and one data signal compensation line is connected to the data signal write terminal of each dummy sub-pixel in the column of the dummy sub-pixels; and wherein in the column of the dummy sub-pixels, a number of dummy sub-pixels is equal to a number of display sub-pixels, and the dummy sub-pixels and the display sub-pixels are in one-to-one correspondence in the row direction.

4. The display panel according to claim 3, wherein the non-display area is further provided with a gate driving circuit connected to the driver chip; and the gate driving circuit is connected to scan signal write terminals of the pixel driving circuits of the dummy sub-pixels and of the display sub-pixels on the same row through a scan signal line extending in the row direction.

5. The display panel according to claim 3, wherein the non-display area is further provided with a gate driving circuit connected to the driver chip, the gate driving circuit being connected to a scan signal write terminal of the pixel driving circuit in the display sub-pixel through a scan signal line extending in the row direction;

wherein the compensation line further comprises at least one scan signal compensation line extending in the column direction, the scan signal compensation line and the data signal compensation line are arranged at intervals, one scan signal compensation line is connected to the scan signal write terminal of each dummy sub-pixel in the column of the dummy sub-pixels, and is further connected to the driver chip;

wherein the driver chip is further configured to generate a scan compensation signal when the current signal fed back by the feedback line is not equal to the preset threshold value, the scan signal compensation line transmitting the scan compensation signal to the scan signal write terminal of each dummy sub-pixel; and wherein the driver chip is further configured to output a display scan compensation signal to the gate driving circuit based on the scan compensation signal when the compensated current signal fed back by the feedback line is equal to the preset threshold.

6. The display panel according to claim 5, wherein the scan signal line and the scan signal compensation line are arranged in different layers and insulated from each other.

7. The display panel according to claim 4, wherein the gate driving circuit is located on a side of the dummy sub-pixel away from the plurality of display sub-pixels.

8. The display panel according to claim 4, wherein the pixel driving circuit comprises:

a storage capacitor provided with a first pole connected to a first node and a second pole connected to a second node, the second node being connected to a first pole of the light-emitting element;

a drive transistor provided with a control terminal connected to the first node, a first terminal of the drive transistor being connected to a power supply voltage terminal, and a second terminal of the drive transistor being connected to the second node;

a reset transistor provided with a control terminal for inputting a read signal, a first terminal of the reset transistor being for inputting a reference signal, and a second terminal of the reset transistor being connected to the second node; and a charge transistor is provided with a control terminal serving as the scan signal write terminal, a first terminal of the charge transistor serving as a data signal write terminal, and a second terminal of the charge transistor being connected to the first node.

9. The display panel according to claim 8, wherein the read signal and the reference signal are provided by the driver chip.

10. A display device comprising a display panel, wherein the display panel comprises:

a display area comprising a plurality of display lines and a plurality of display sub-pixels arranged in arrays; and a non-display area surrounding the display area, wherein the non-display area further comprises a dummy sub-pixel, a driver chip, a feedback line and a compensation line;

wherein the dummy sub-pixel and the plurality of display sub-pixels are provided with a light-emitting element and a pixel driving circuit with the same internal configuration;

wherein the light-emitting element is provided with a first pole and a second pole;

wherein in the dummy sub-pixel and the plurality of display sub-pixels, the first pole of the light-emitting element is connected to the pixel driving circuit;

wherein in the plurality of display sub-pixels, the second pole of the light-emitting element is connected to a common ground terminal, and the pixel driving circuit is connected to the driver chip through the display line;

wherein in the dummy sub-pixel, the second pole of the light-emitting element is directly connected to the driver chip through the feedback line, and the pixel driving circuit is connected to the driver chip through the compensation line; and wherein the driver chip is configured to acquire a current signal of a light-emitting element in the dummy sub-pixel through the feedback line, and to generate a compensation signal when the current signal fed back by the feedback line is not equal to a preset threshold value, wherein the compensation signal is inputted to a pixel driving circuit of the dummy sub-pixel through the compensation line to compensate the light-emitting element of the dummy sub-pixel, and wherein the driver chip is further configured to generate a display compensation signal based on the compensation signal when the compensation signal makes the current signal fed back by the feedback line equal to the preset threshold value, and the display compensation signal is transmitted to the pixel driving circuit of the display sub-pixel through the display line.

11. The display device according to claim 10, wherein the plurality of display lines comprise a data signal line for connecting the driver chip and a data signal write terminal of the pixel driving circuit in the plurality of display sub-pixels;

wherein the compensation line comprises a data signal compensation line for connecting the driver chip and the data signal write terminal of the pixel driving circuit in the dummy sub-pixel;

wherein the driver chip is configured to generate a data compensation signal when the current signal fed back by the feedback line is not equal to the preset threshold value, and the data signal compensation line transmits the data compensation signal to the data signal write terminal of the dummy sub-pixel; and wherein the driver chip is further configured to generate a display data compensation signal based on the data compensation signal when the current signal fed back by the feedback line after compensation is equal to the preset threshold value, and the data signal line transmits the display data compensation signal to the data signal write terminal of the plurality of display sub-pixels through the data signal line.

12. The display device according to claim 11, wherein a plurality of columns of display sub-pixels are provided in a row direction;

wherein at least one column of dummy sub-pixels is provided, at least one data signal compensation line is provided and extends in a column direction, and one data signal compensation line is connected to the data signal write terminal of each dummy sub-pixel in the column of the dummy sub-pixels; and wherein in the column of the dummy sub-pixels, a number of dummy sub-pixels is equal to a number of display sub-pixels, and the dummy sub-pixels and the display sub-pixels are in one-to-one correspondence in the row direction.

13. The display device according to claim 12, wherein the non-display area is further provided with a gate driving circuit connected to the driver chip; and the gate driving circuit is connected to scan signal write terminals of the pixel driving circuits of the dummy sub-pixels and of the display sub-pixels on the same row through a scan signal line extending in the row direction.

14. The display device according to claim 12, wherein the non-display area is further provided with a gate driving circuit connected to the driver chip, the gate driving circuit being connected to a scan signal write terminal of the pixel driving circuit in the display sub-pixel through a scan signal line extending in the row direction;

wherein the compensation line further comprises at least one scan signal compensation line extending in the column direction, the scan signal compensation line and the data signal compensation line are arranged at intervals, one scan signal compensation line is connected to the scan signal write terminal of each dummy sub-pixel in the column of the dummy sub-pixels, and is further connected to the driver chip;

wherein the driver chip is further configured to generate a scan compensation signal when the current signal fed back by the feedback line is not equal to the preset threshold value, the scan signal compensation line transmitting the scan compensation signal to the scan signal write terminal of each dummy sub-pixel; and wherein the driver chip is further configured to output a display scan compensation signal to the gate driving circuit based on the scan compensation signal when the compensated current signal fed back by the feedback line is equal to the preset threshold.

15. The display device according to claim 14, wherein the scan signal line and the scan signal compensation line are arranged in different layers and insulated from each other.

16. The display device according to claim 13, wherein the gate driving circuit is located on a side of the dummy sub-pixel away from the plurality of display sub-pixels.

17. The display device according to claim 13, wherein the pixel driving circuit comprises:

a storage capacitor provided with a first pole connected to a first node and a second pole connected to a second node, the second node being connected to a first pole of the light-emitting element;

a drive transistor provided with a control terminal connected to the first node, a first terminal of the drive transistor being connected to a power supply voltage terminal, and a second terminal of the drive transistor being connected to the second node;

a reset transistor provided with a control terminal for inputting a read signal, a first terminal of the reset transistor being for inputting a reference signal, and a second terminal of the reset transistor being connected to the second node; and a charge transistor is provided with a control terminal serving as the scan signal write terminal, a first terminal of the charge transistor serving as a data signal write terminal, and a second terminal of the charge transistor being connected to the first node.

18. The display device according to claim 17, wherein the read signal and the reference signal are provided by the driver chip.

* * * * *